US012024390B2

(12) United States Patent
Oh

(10) Patent No.: US 12,024,390 B2
(45) Date of Patent: Jul. 2, 2024

(54) MULTI-DIVISION TYPE TAPE CUTTER

(71) Applicant: Yong Chul Oh, Seoul (KR)

(72) Inventor: Yong Chul Oh, Seoul (KR)

(73) Assignee: TENDO CO., LTD. (KR)

( * ) Notice: Subject to any disclaimer, the term of this patent is extended or adjusted under 35 U.S.C. 154(b) by 0 days.

(21) Appl. No.: 17/050,456

(22) PCT Filed: Apr. 29, 2019

(86) PCT No.: PCT/KR2019/005123
§ 371 (c)(1),
(2) Date: Oct. 26, 2020

(87) PCT Pub. No.: WO2020/175740
PCT Pub. Date: Sep. 3, 2020

(65) Prior Publication Data

US 2021/0403272 A1 Dec. 30, 2021

(30) Foreign Application Priority Data

Feb. 27, 2019 (KR) ..... 10-2019-0022977
Apr. 8, 2019 (KR) ..... 10-2019-0040749

(51) Int. Cl.
*B65H 35/00* (2006.01)

(52) U.S. Cl.
CPC ..... *B65H 35/0086* (2013.01); *B65H 35/002* (2013.01); *B65H 2301/5154* (2013.01); *B65H 2701/377* (2013.01)

(58) Field of Classification Search
CPC ..... B65H 35/0086; B65H 35/002; B65H 35/0026; B65H 35/08
See application file for complete search history.

(56) References Cited

U.S. PATENT DOCUMENTS 2,788,852 A * 4/1957 Sharpe ..... B65H 35/02 225/24
2,849,065 A * 8/1958 Krueger ..... B65H 35/0073 225/24
2007/0235494 A1* 10/2007 Foran ..... B65H 35/0073 225/39

(Continued)

FOREIGN PATENT DOCUMENTS

CN 105473477 A * 4/2016 ..... B65H 35/0033
CN 107522006 A * 12/2017 ..... B65H 35/02
KR 20110108616 A * 10/2011

(Continued)

*Primary Examiner* — Jennifer S Matthews

(57) ABSTRACT

A multi-division type tape cutter is disclosed. A multi-division type tape cutter according to the present invention includes: a rotating member which has a cylindrical shape and includes a fastening protrusion provided on one side surface thereof and a plurality of rotating wings provided along the outer cylindrical circumferential surface thereof, each of the rotating wings having a ¬-shaped end; a tape roller into which a tape is fitted; a housing forming a body, wherein the rotating member and the tape roller are fixed to the inside of the housing, a first cutter unit located between the rotating member and the tape roller and provided in a direction orthogonal to a winding direction of the tape; and a second cutter unit provided inside the housing in a direction orthogonal to the winding direction of the tape.

1 Claim, 8 Drawing Sheets

(56) References Cited

U.S. PATENT DOCUMENTS

| | | | | |
|---|---|---|---|---|
| 2008/0271853 | A1* | 11/2008 | Steele | B65H 35/0033 156/527 |
| 2016/0159603 | A1* | 6/2016 | Huang | B65H 35/0026 83/161 |

FOREIGN PATENT DOCUMENTS

| | | | | |
|---|---|---|---|---|
| KR | 20-20120-003171 | | 5/2012 | |
| KR | 101216504 | B1 * | 12/2012 | |
| KR | 10-2013-0025659 | | 3/2013 | |
| KR | 20130025659 | A * | 3/2013 | |
| KR | 10-2013-0065526 | | 6/2013 | |
| KR | 20-2014-0001066 | | 2/2014 | |
| KR | 20140104483 | A * | 8/2014 | B65H 35/002 |
| KR | 101799992 | B1 * | 11/2017 | |

* cited by examiner (a)

(b)

MULTI-DIVISION TYPE TAPE CUTTER

CROSS-REFERENCE TO RELATED APPLICATIONS

This application is a national stage application of International Patent Application No. PCT/KR2019/005123 filed on Apr. 29, 2019, which claims priority to Korean Patent Application No. 10-2019-0022977 filed on Feb. 27, 2019 and Korean Patent Application No. 10-2019-0040749 filed on Apr. 8, 2019, the entire contents of which are incorporated by reference herein.

TECHNICAL FIELD

The present invention relates to a tape cutter, and more particularly, to a multi-division type tape cutter that is capable of easily cutting an adhesive tape to a desired width.

BACKGROUND

Adhesive tapes are used for multiple purposes in daily life, and various kinds and sizes of adhesive tapes have been released and distributed on the market.

The purposes of adhesive tapes may be changed according to the widths of the adhesive tapes, and accordingly, the adhesive tape having the width adequate to the purpose thereof is selected by a consumer.

If strong adhesion is needed to seal, for example, a fruit box, a packaging box, and the like, an adhesive tape whose width is large, which is called 'box-sealing tape', is generally used, and contrarily, if weak adhesion is needed to seal, for example, a letter envelope, office paper, and the like, an adhesive tape whose width is small is generally used.

In environments where the adhesive tapes are frequently used for multiple purposes, therefore, the adhesive tapes with various widths are normally possessed.

In this case, the respective tapes should be purchased to undesirably increase a tape purchasing cost, and if the adhesive tape possessed does not have a width adequate to the purpose thereof, an adhesive tape with a width adequate to the purpose thereof has to be additionally purchased.

If the existing tape is divided according to a desired width, in this case, it can be utilized according to its purpose, without purchasing any additional tape.

So as to divide the tape to a desired width, however, the tape has to be cut to a user's desired width in a longitudinal direction thereof by means of a separate cutting tool like scissors, cutter, and so on.

To do this, however, the tape is first cut to the desired length and is then attached to a place like a desk, and in this state, if the tape is cut in the longitudinal direction thereof, an adhesive surface of the tape may be stained to undesirably cause adhesion of the tape to be weakened.

On the other hand, a waterwheel type tape cutter in a conventional practice, like "dispenser capable of adjusting cutting length of tape" as disclosed in Korean Patent No. 10-1868994 is useful in cutting the tape to a desired length, but unfortunately, the conventional tape cutter cannot cut the tape to a desired width.

Accordingly, the present invention has been made to solve the above-mentioned problems, and it is an object of the present invention to provide a multi-division type tape cutter that is capable of easily cutting an adhesive tape to a desired width.

SUMMARY

To accomplish the above-mentioned objects, according to the present invention, there is provided a multi-division type tape cutter provided with a cylindrical rotating member constituted of a fastening protrusion protruding from one side surface thereof and a plurality of rotating wings provided along an outer peripheral surface thereof in such a manner as to have '¬'-shaped upper ends and a rotating roller adapted to fit a tape thereto, the multi-division type tape cutter including: a housing providing a body thereof in such a manner as to allow the rotating member and the tape roller to be fixed to the inside thereof; a first cutter unit located between the rotating member and the tape roller in a direction orthogonal to a winding direction of the tape; and a second cutter unit located inside the housing in the direction orthogonal to the winding direction of the tape.

In this case, the first cutter unit is detachably mounted on the housing.

Also, the first cutter unit includes a fixing bar and two or more cylinders detachably fitted to the fixing bar.

Further, the first cutter unit includes one or more cutting blades located on each cylinder in the corresponding direction to the winding direction of the tape.

Furthermore, the housing has seating grooves formed on both left and right sides of top thereof, so that as the fixing bar of the first cutter unit is fitted to the seating grooves, the first cutter unit is provided in the direction orthogonal to the winding direction of the tape.

On the other hand, the second cutter unit includes a plurality of blade supports and blades provided on one side tops of the blade supports, one side end portions of the blade supports being slantly formed to a given angle to allow the blades to come into contact with the tape at a right angle with respect to the tape.

In addition, the blades of the second cutter unit are linearly inclined to a given angle in one side direction thereof.

Further, the multi-division type tape cutter further includes a cover unit seated onto cover seating portions formed on portions of both left and right sides of the housing in such a manner as to allow the first cutter unit to be covered therewith.

Furthermore, the tape roller includes tension adjustors formed on portions of both left and right sides of the outer peripheral surface thereof, each tension adjustor having one or more incised portions formed in the direction orthogonal to the winding direction of the tape.

According to the present invention, the multi-division type tape cutter can freely cut the tape to the user's desired width, so that the existing tape can be freely used, without purchasing any separate tape.

Generally, a box-sealing tape whose width is large has a lower price per area than a tape whose width is small, and if the box-sealing tape is used dividedly through the multi-division type tap cutter according to the present invention, a tape purchasing cost can be more reduced when compared with the case where various kinds of tapes have to be purchased.

Further, if it is necessary to use a tape whose width is small or large without any division, the multi-division type tap cutter according to the present invention can be just used in the same manner as the conventional tape cutter, so that it is available for the existing tapes having various widths.

EXPLANATIONS ON REFERENCE NUMERALS

Figure 1:
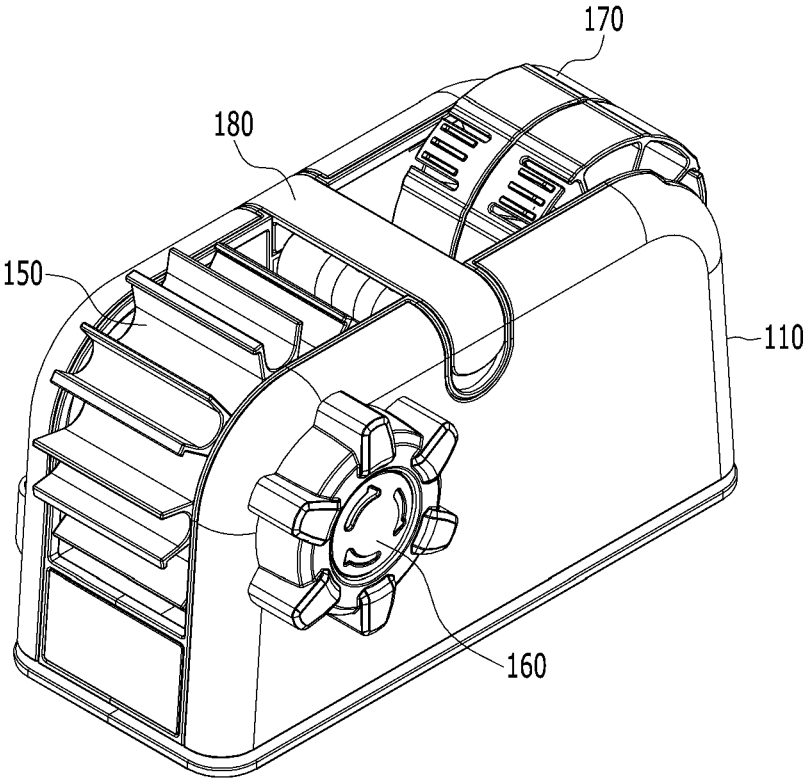
FIG. 1 shows a multi-division type tape cutter according to the present invention.

1: tape
100: multi-division type tape cutter
110: housing
111: seating groove
112: cover seating portion
120: first cutter unit
121: fixing bar
122: cylinder
123: cutting blade
130: second cutter unit
131: blade support
132: blade
150: rotating member
151: fastening protrusion
152: rotating wing
160: cutter handle
161: fastening groove
170: tape roller
171: tension adjustor
180: cover unit

DETAILED DESCRIPTION OF THE DISCLOSURE

Hereinafter, the present invention will now be described in detail with reference to the attached drawings wherein the corresponding parts in the embodiments of the present invention are indicated by corresponding reference numerals.

In the description, when it is said that one portion is described as "includes" any component, one element further may include other components unless no specific description is suggested.

FIG. 1 shows a multi-division type tape cutter 100 according to the present invention.

A housing 110 is a body of the multi-division type tape cutter 100 and has a cutter handle 160 coupled to one side surface thereof, while having an internal space open penetratedly on both side ends thereof in such a manner as to allow a rotating member 150 and a tape roller 170 to be coupled to both sides thereof.

Further, the housing 110 has cover seating portions 112 formed on both sides of a center of top thereof in such a manner as to have grooves corresponding to leg shapes of a cover unit 180, and through the cover seating portions 112, accordingly, the cover unit 180 can be detachably mounted on the housing 110.

The rotating member 150 is coupled to one side end of the internal space of the housing 110 to guide a tape wound by means of rotation to the first cutter unit 120 and a second cutter unit 130 and to thus move the cut tape to the open space of the top of the housing 110, so that the cut tape is detached by a user.

Figure 2:
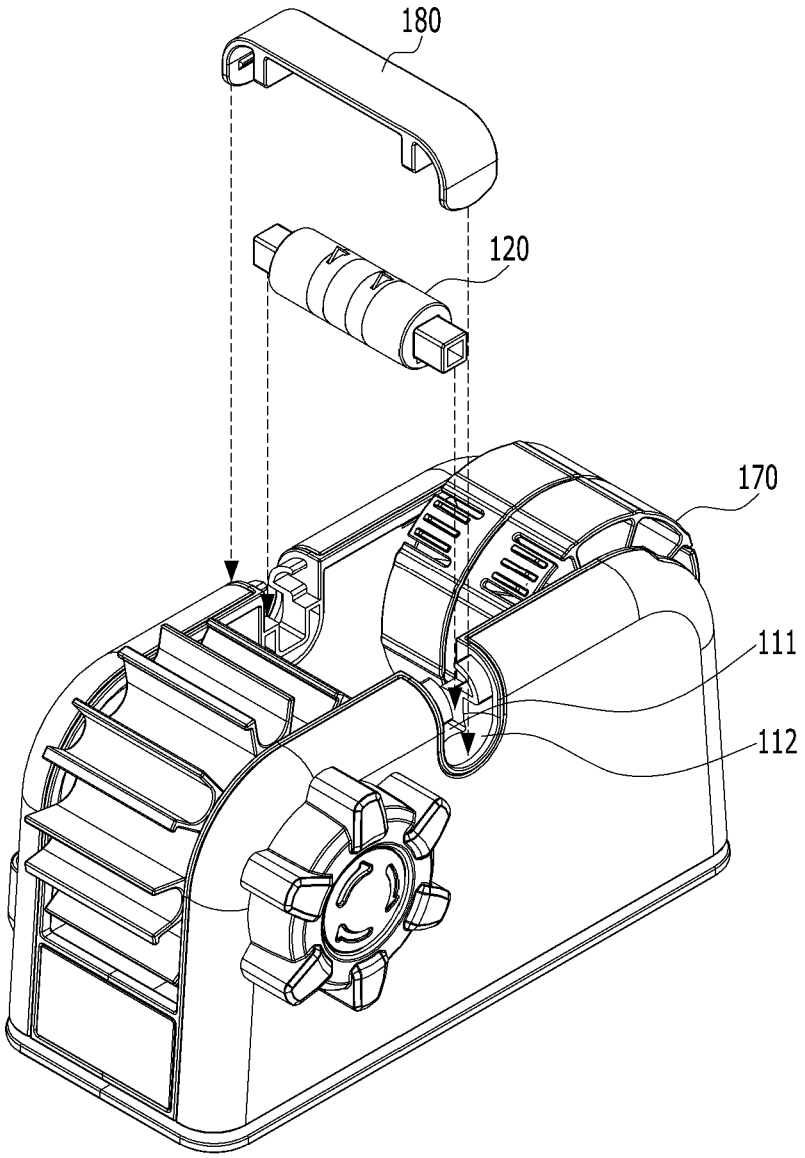
FIG. 2 shows a state where a first cutter unit and a cover unit are detached from a housing of the multi-division type tape cutter according to the present invention.

FIG. 2 shows a state where the first cutter unit 120 and the cover unit 180 are to detached from the housing 110.

The housing 110 has seating grooves 111 formed on both sides of the center of the top thereof, and as both ends of a fixing bar 121 of the first cutter unit 120 are fitted to the seating grooves 111, the first cutter unit 120 is seated onto the seating grooves 111.

The cover unit 180 is located above the first cutter unit 120, and as surrounding portions of the seating grooves 111 are depressed to form the cover seating portions 112, the cover unit 180 is fitted to the cover seating portions 112 in such a manner as to cover the first cutter unit 120 therewith.

As a result, safety accidents which may be caused by the first cutter unit 120 having cutting blades 123 directed upward therefrom can be prevented, and also, the cutting blades 123 can be protected from external impacts.

According to the present invention, further, the tape 1 unwound initially from the tape roller 170 is first divided in a transverse direction by means of the first cutter unit 120 and then moves in a rotating direction thereof. Accordingly, a position where the first cutter unit 120 is seated is desirably provided between the rotating member 150 and the tape roller 170.

Figure 3:
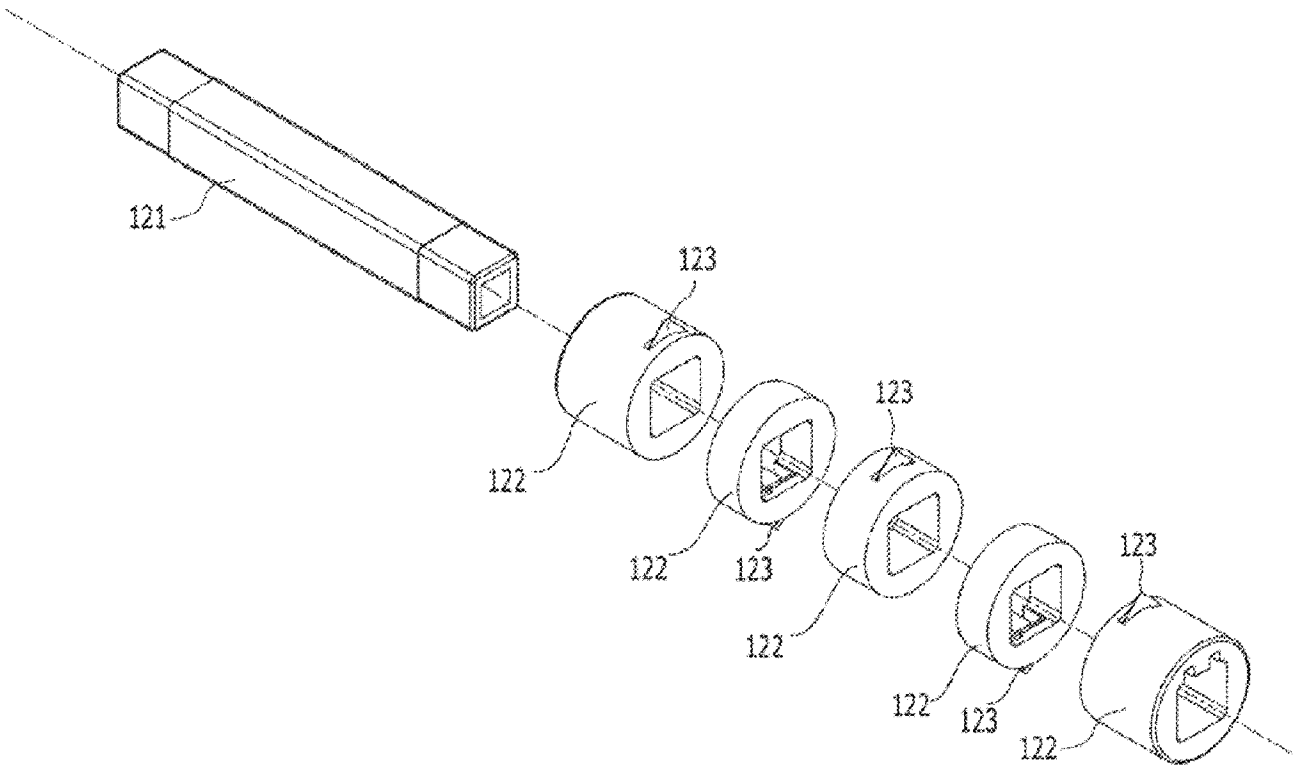
FIG. 3 shows the first cutter unit of the multi-division type tape cutter according to the present invention.

FIG. 3 shows the first cutter unit 120 in detail.

The first cutter unit 120 has a shape of a general bar and is constituted of the fixing bar 121 fitted to the seating grooves 111 and cylinders 122 detachably fitted to the fixing bar 121.

Especially, two or more divided cylinders 122 are provided, and one or more cutting blades 123 are located on one side of each cylinder 122.

In this case, the cylinders 122 are fitted to the fixing bar 121 in such a manner as to allow the cutting blades 123 to be directed upward or downward therefrom according to the user's desired direction.

Figure 4:
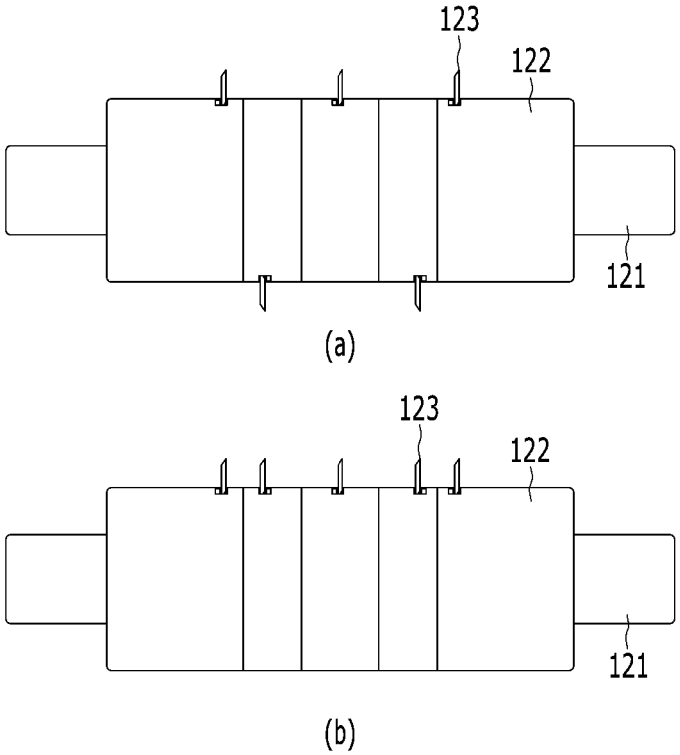
FIGS. 4A and 4B show examples where cylinders are fitted to a fixing bar in such a manner as to allow cutting blades to be different in position from each other.

FIGS. 4A and 4B show examples where the cylinders 122 are fitted to the fixing bar 121 in such a manner as to allow the cutting blades 123 to be different in position from each other.

The cylinders 122 are fitted to the fixing bar 121 in such a manner as to allow cutting blades 123 coming into contact with the tape to divide the tape into given parts to be directed upward therefrom and to allow the cutting blades 123 not used to divide the tape into the given parts to be directed downward therefrom.

As shown in FIG. 4A, the cylinders 122 where the second and fourth cutting blades 123 from the left side of the figure are directed downward therefrom are fitted to the fixing bar 121, and accordingly, the tape can be divided into four parts in the transverse direction thereof by means of the rest of the cutting blades 123 directed upward from the cylinders 122.

If necessary, as shown in FIG. 4B, the cylinders 122 where all of the cutting blades 123 are directed upward therefrom are fitted to the fixing bar 121 to divide the tape into the maximum six parts in the transverse direction thereof.

FIGS. 4A and 4B show just examples of the cylinders 122 according to the present invention, and of course, the cylinders 122 can be detached from the fixing bar 121 to allow the cutting blades 123 directed upward therefrom to be freely arranged according to desired division widths or parts of the tape.

Accordingly, the tape can be divided into two, three, fourth, and other parts.

On the other hand, the cutting blades 123 are detachably mounted on the cylinders 122, and if they become dull, they can be desirably exchanged with new ones.

The first cutter unit 120 rotates in an advancing direction of the tape to cause its cutting force to be greatly reduced by means of a friction force between the cutting blades 123 and the tape when the tape is cut through the cutting blades 123, but according to the present invention, since the fixing bar 121 desirably has a square sectional shape, as shown in FIG. 3, the cutting force of the first cutter unit 120 can be prevented from being reduced.

Accordingly, through holes formed on the cylinders 122 desirably have square sectional shapes corresponding to the sectional shape of the fixing bar 121.

According to the present invention, in addition, each cylinder 122 has only one cutting blade 123, but of course, it is possible that each cylinder 122 may have one or more cutting blades 123 in the same direction as each other to increase the divided parts of the tape.

Figure 5:
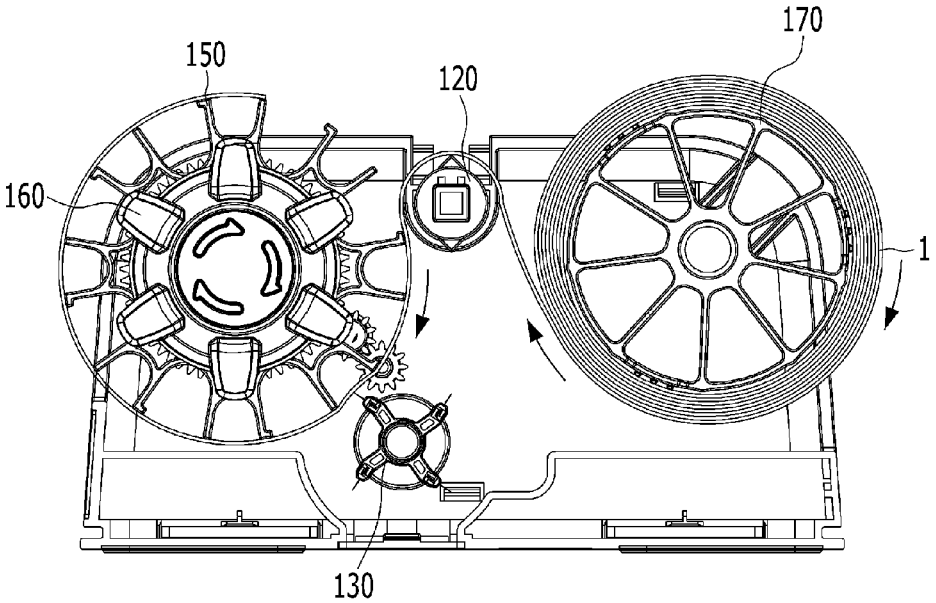
FIG. 5 shows a process where a tape is cut by means of the multi-division type tape cutter according to the present invention.

FIG. 5 shows a process where the tape is cut by means of the multi-division type tape cutter according to the present invention.

The tape roll 1 is fitted to the tape roller 170 in such a manner as to allow an adhesive surface thereof to be directed upward when the tape is unwound therefrom.

An initial tape end is detached by a user and is then attached to ends of rotating wings 152 of the rotating member 150. Next, the cutter handle 160, which is provided on the outer surface of one side of the housing 110, at which the rotating member 150 is located, rotates so that the rotating member 150 rotates to allow the tape to be unwound from the tape roll 1.

On the other hand, the tape unwound from the tape roll 1 moves in directions of arrows. First, the tape moves over the first cutter unit 120 and is divided in width into multiple parts by means of the cutting blades 123 directed upward from the first cutter unit 120.

If all of the cutting blades 123 are directed downward from the cylinders 122 of the first cutter unit 120, however, the tape is kept in its original width, without any division.

The tape 1 whose width is divided into the multiple parts is cut to a given length by means of the second cutter unit 130 provided on the bottom of an internal space of the housing 110 in a direction orthogonal to a winding direction of the tape.

After that, the tape, which is cut to the desired width and length, rotates in a state of being attached to the rotating wings 152 of the rotating member 150 and thus moves upward.

Figure 6:
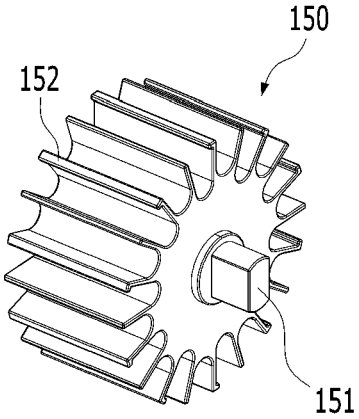
FIGS. 6A and 6B show a rotating member and a cutter handle of the multi-division type tape cutter according to the present invention.
Figure 6:
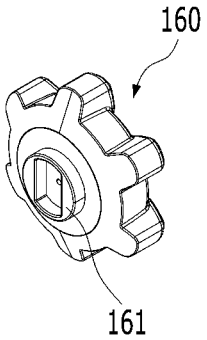

FIGS. 6A and 6B show the rotating member 150 and the cutter handle 160 in detail.

As shown in FIG. 6A, the rotating member 150 includes a cylindrical center portion having a fastening protrusion 151 protruding from one side thereof and a fastening groove formed on the other side thereof and the rotating wings 152 extended upward from the outer peripheral surface of the cylindrical center portion to wing shapes of a waterwheel.

Some of the rotating wings 152 have upper ends bent to a right angle to the shape of '¬', and accordingly, they are arranged alternately with the rotating wings 152 having linear type upper ends.

As the rotating wings 152 have the ends bent to the shape of '¬', they have given areas on the ends thereof, and in this case, the tape is fixedly attached to the ends of the rotating wings 152, so that when the rotating member 150 rotates, the tape can rotate, together.

Further, desirably, the fastening protrusion 151 is arch-shaped on both ends thereof in such a manner as to be linearly connected to both left and right sides thereof from both ends thereof, so that a torque generated when the cutter handle 160 rotates can be more effectively locked onto the fastening protrusion 151.

FIG. 6B shows the cutter handle 160 in detail, and desirably, the cutter handle 160 has a fastening groove formed on a rear surface thereof in such a manner as to insert the fastening protrusion 151 of the rotating member 150 thereinto. The cutter handle 160 is coupled to one side surface of the housing 110 and rotates by the manipulation of the user to allow the rotating member 150 to rotate.

In more detail, the fastening groove 161 formed on the rear surface of the cutter handle 160 has a shape corresponding to the sectional shape of the fastening protrusion 151 of the rotating member 150, so that the fastening protrusion 151 passes through a through hole (not shown) formed on one side surface of the inside of the housing 110 and is then inserted into the fastening groove 161 formed on the rear surface of the cutter handle 160.

Further, the groove formed on the other side of the rotating member 150 is circular, which corresponds to a sectional shape of a shaft protrusion (not shown) formed on the other side surface of the inside of the housing 110 to face the through hole, so that the shaft protrusion is fitted to the groove of the rotating member 150.

As a result, the rotating member 150 can rotate around a linear shaft provided by connecting the shaft protrusion to the fastening groove.

In this case, if the cutter handle 160 rotates by the user, the torque generated by the rotary force of the cutter handle 160 is applied to the rotating member 150, and accordingly, the fastening protrusion 151 rotates to allow the whole rotating member 150 to rotate.

Figure 7:
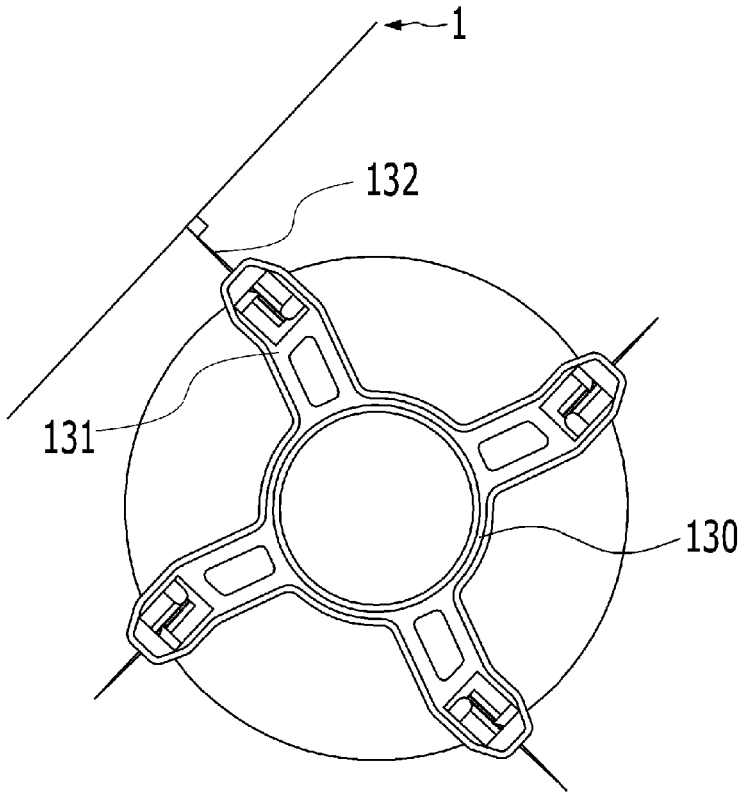
FIG. 7 shows a state where the tape is cut by means of a second cutter unit of the multi-division type tape cutter according to the present invention.

FIG. 7 shows a state where the tape is cut by means of the second cutter unit 130 in detail.

Desirably, the second cutter unit 130 has a cylinder with grooves formed on both ends of a center thereof, and in this case, protrusions formed on lower portions of both side surfaces of the inside of the housing 110 are fitted to the grooves, so that the second cutter unit 130 rotates in a state of being coupled to the housing 110.

Desirably, the second cutter unit 130 includes a plurality of blade supports 131 extended upward from the outer peripheral surface of the cylinder in a longitudinal direction of the cylinder and blades 132 provided on the tops of the blade supports 131 to cut the tape to desired lengths.

In the conventional tape cutters, however, the blade supports 131 are located in a vertical direction with respect to the center portion of the second cutting unit 130, so that in a state where the blade supports 131 do not have any right angle with respect to the tape at a point where the tape and the second cutting unit 130 meet each other, the tape is cut. In this case, the cutting force becomes weakened, and also, the cut end of the tape may become irregular.

According to the present invention, however, the end portions of the blade supports 131 are slantly formed to a given angle in a rotating direction of the blade supports 131, as shown in FIG. 7, and accordingly, the blades 132 of the second cutter unit 130 come into contact with the tape at the right angle with respect to the tape and thus cut the tape.

As a result, the multi-division type tape cutter according to the present invention has better cutting forces than the conventional tape cutters and also provides more regularly cut ends of the tape than the conventional tape cutters.

Figure 8:
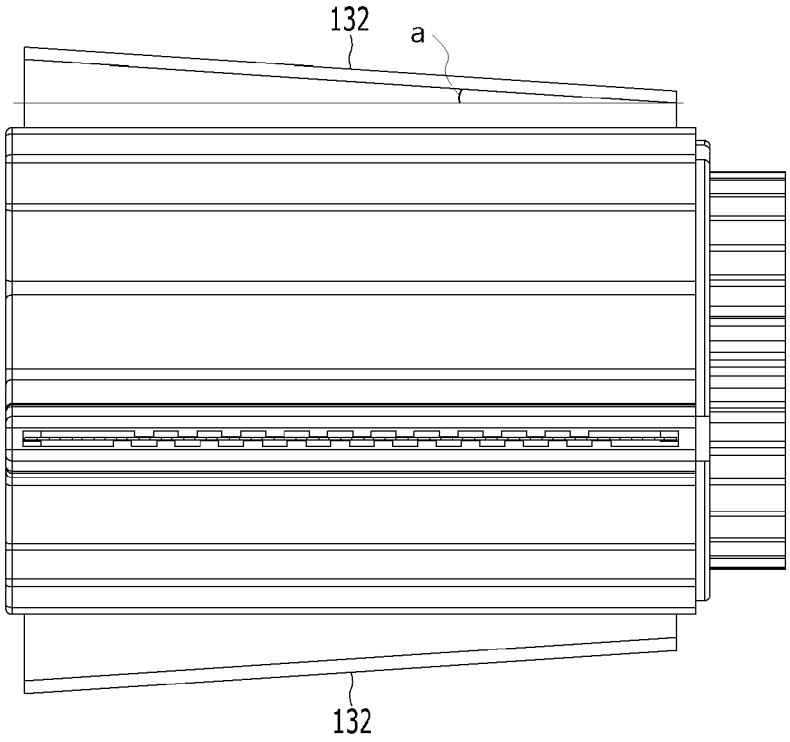
FIG. 8 shows cutting blades of the second cutter unit of the multi-division type tape cutter according to the present invention.

In addition, FIG. 8 shows the blades 132 of the second cutter unit 130 in detail.

In the conventional tape cutters, generally, the blades 132 of the second cutter unit 130 are saw blades.

Accordingly, the cut section of the tape is concave and convex, so that it is not smooth. Further, a portion to which the tape is attached does not have any good outer appearance.

In the multi-division type tape cutter according to the present invention, contrarily, the blades 132 of the second cutter unit 130 have linear types, not the saw blade types, as shown in FIG. 8, so that the cut section of the tape can be linearly formed in a neat manner, without being concave and convex.

Further, the blades 132 are inclined to a given angle in one side direction thereof.

In this case, desirably, the given angle is in the range of 1 to 25°.

Through the inclination of the blades 132 to the given angle, at the time when the blades 132 come into contact with the tape and thus cut the tape, the high portion of each blade 132 first comes into contact with the tape and the low portion of each blade 132 secondarily comes into contact with the tape, so that a cutting force can be more improved when compared with that when the blade comes into contact with the tape at a time.

Figure 9:
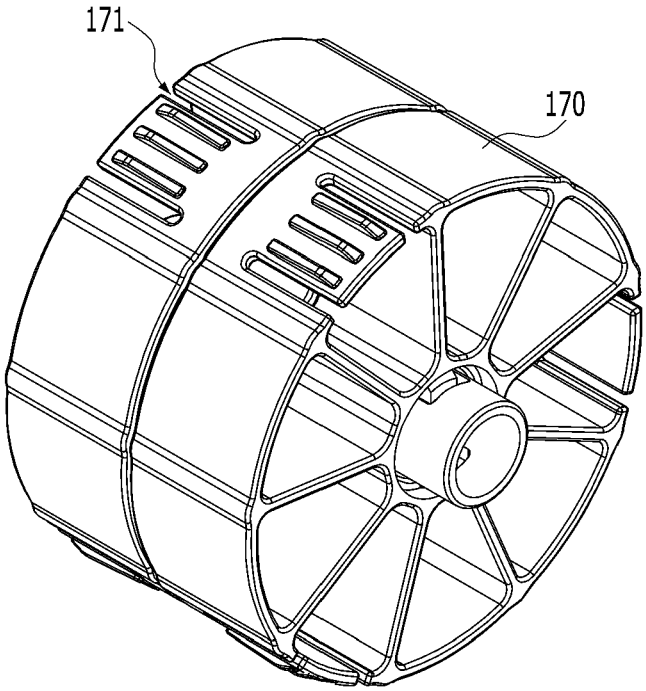
FIG. 9 shows a tape roller of the multi-division type tape cutter according to the present invention.

FIG. 9 shows the tape roller 170 in detail.

The tape roller 170 is a portion to which a core of the tape roll 1 is fitted to thus fix the tape roll 1 thereto, so that the tape roll 1 cannot escape from the multi-division type tape cutter during rotation.

According to the present invention, a peripheral length of the tape roller 170 is somewhat larger than that of the core of the tape roll 1, and further, the tape roller 170 has tension adjustors 171 formed on one side thereof, and each tension adjustor 171 has one or more incised portions formed in a direction orthogonal to the winding direction of the tape.

When the core of the tape roll 1 is fitted to the tape roller 170, a fitting pressure is applied to the incised portions so that the widths of the incised portions become reduced to allow the core of the tape roll 1 to be fitted well to the tape roller 170. After the fitting, of course, the tape roller 170 applies an outward pushing force to the core of the tape roll 1 by means of elastic forces of the incised portions, so that the tape roll 1 can be more firmly fixed to the tape roller 170 when compared with that in the conventional tape cutter.

As described above, the technical scope of the present invention has been described with reference to the particular illustrative embodiments.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings. It is therefore intended that the scope of the invention be limited not by this detailed description, but rather by the claims appended hereto.

What is claimed is:

1. A multi-division type tape cutter comprising:

a cylindrical rotating member comprising a plurality of rotating wings provided along an outer peripheral surface thereof; a rotating roller adapted to fit a tape thereto, wherein the cylindrical rotating member rotates to allow the tape to be unwound;

a housing accommodating the rotating member and the rotating roller;

a first cutter unit detachably engaged to the housing, the first cutter unit comprising a fixing bar and a plurality of adapters mounted on the fixing bar, wherein, the fixing bar is an elongated member defining a first cross section;

each of the adapters define a through hole complementing the first cross section, wherein the adapters are detachably mounted, adjacent to each other, over the fixing bar, by having the fixing bar pass through the through holes of the adapters;

a shape of the first cross section prevents rotation of the adapter that is received by the fixing bar;

each of the adapters comprises a cutting blade;

each of the adapters is operable to be independently mounted on the fixing bar selectively in a first orientation, wherein the adapter is oriented in a first angular configuration relative to the fixing bar, while mounting the adapter on the fixing bar, wherein the cutting blade interfaces with the tape to cut the tape along a length of the tape;

each of the adapters is operable to be independently mounted on the fixing bar selectively in a second orientation, wherein the adapter is oriented in a second angular configuration, relative to the fixing bar, while mounting the adapter on the fixing bar, wherein the cutting blade faces away from the tape to refrain from cutting the tape, the first angular configuration being angularly offset from the second angular configuration about a longitudinal axis of the fixing bar;

at least two of the adapters have different widths along the longitudinal axis of the fixing bar;

each of the adapters are operable to be mounted on the fixing bar in an order selected by a user, thereby defining a position of the adapters along the fixing bar, with each adapter pressing against the adapter adjacent to it, thereby allowing the adapters to be positioned in desired positions along the fixing bar, once the fixing bar is engaged to the housing;

a number of slits the tape is cut into and a width of each of the slits is based on combination of the adapters in the first orientation and the second orientation, and the order in which the adapters are mounted over the fixing bar; and a second cutter unit configured to cut the tape along a width of the tape, wherein, the second cutter unit comprises a plurality of blade supports extending from an outer periphery surface of a cylinder and a second cutter blade provided on a free side of each of the blade supports; each free side of the blade support comprises an edge portion slanted at an angle offset from a radius extending from an axis of rotation of the second cutter;

the angle of the offset of the edge portion is defined to enable a selected one of the second cutter blades to cut the tape by interfacing perpendicularly with the tape to define a "T" shaped configuration, wherein a horizontal line of the "T" is defined by the tape and a vertical line of the "T" is defined by the second cutter blade; and each second cutter blade comprises a proximal end having a first height and a distal end having a second height, the first height being greater than the second height, and the proximal end configured to contact the tape before the distal end of the blade.

* * * * *